US011450951B2

(12) United States Patent
Zhang et al.

(10) Patent No.: US 11,450,951 B2
(45) Date of Patent: Sep. 20, 2022

(54) FILTERING, POWER-DIVIDING AND PHASE-SHIFTING INTEGRATED ANTENNA ARRAY FEED NETWORK

(71) Applicant: SOUTH CHINA UNIVERSITY OF TECHNOLOGY, Guangdong (CN)

(72) Inventors: Xiuyin Zhang, Guangzhou (CN); Wanli Zhan, Guangzhou (CN); Jinxu Xu, Guangzhou (CN); Yunfei Cao, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 74 days.

(21) Appl. No.: 17/262,759

(22) PCT Filed: Mar. 11, 2020

(86) PCT No.: PCT/CN2020/078706
§ 371 (c)(1),
(2) Date: Jan. 25, 2021

(87) PCT Pub. No.: WO2020/228402
PCT Pub. Date: Nov. 19, 2020

(65) Prior Publication Data

US 2021/0313676 A1 Oct. 7, 2021

(30) Foreign Application Priority Data

May 10, 2019 (CN) ..... 201910388869.0

(51) Int. Cl.
*H01Q 1/48* (2006.01)
*H01Q 1/50* (2006.01)
(Continued)

(52) U.S. Cl.
CPC ..... *H01Q 1/48* (2013.01); *H01Q 1/50* (2013.01); *H01Q 1/52* (2013.01); *H01Q 21/0006* (2013.01)

(58) Field of Classification Search
CPC .. H01Q 1/48; H01Q 1/50; H01Q 1/52; H01Q 21/00
See application file for complete search history.

(56) References Cited

U.S. PATENT DOCUMENTS

2004/0252059 A1* 12/2004 Zaghloul ..... H01Q 9/0414 343/700 MS

FOREIGN PATENT DOCUMENTS

CN 105591183 5/2016
CN 106602280 4/2017
(Continued)

*Primary Examiner* — Andrea Lindgren Baltzell
(74) *Attorney, Agent, or Firm* — JMB Davis Ben-David

(57) ABSTRACT

The invention discloses a feed network for an antenna array with integrated filtering, power splitting and phase shifting, comprising upper and lower metal floors, metal connecting posts, coaxial feed terminals, a suspended dielectric substrate, suspended strip lines and two phase-adjusting dielectric substrates; the upper and lower metal floors share a common ground through the metal connecting posts, the suspended strip lines are provided on the suspended dielectric substrate, the suspended dielectric substrate is positioned horizontally between the two phase-adjusting dielectric substrates, the two phase-adjusting dielectric substrates are positioned horizontally between the upper and lower metal floors; the suspended strip lines comprise a one-to-three filtering power splitting unit, two one-to-two unequal filtering power splitting units, two first phase-shifting lines and two second phase-shifting lines, the two phase-adjusting dielectric substrates cover the one-to-three filtering power splitting unit, part of the two first phase-shifting lines and the two second phase-shifting lines. The invention provides
(Continued)

integrated design of the three functional circuits with filtering, power splitting and phase shifting to avoid cascading mismatch between different functional circuits in conventional designs.

10 Claims, 4 Drawing Sheets

(51) Int. Cl.
*H01Q 1/52* (2006.01)
*H01Q 21/00* (2006.01)

(56) References Cited

FOREIGN PATENT DOCUMENTS

| | | | |
|---|---|---|---|
| CN | 107369899 | | 11/2017 |
| CN | 109378592 | | 2/2019 |
| CN | 110112572 | | 9/2019 |
| CN | 209929493 | U | 1/2020 |
| WO | 2020228402 | | 11/2020 |

* cited by examiner

FILTERING, POWER-DIVIDING AND PHASE-SHIFTING INTEGRATED ANTENNA ARRAY FEED NETWORK

CROSS-REFERENCE TO RELATED APPLICATIONS

This is the U.S. National Stage of International Patent Application No. PCT/CN2020/078706 filed on Mar. 11, 2020, which in turn claims the benefit of Chinese Patent Application No. 201910388869.0 filed on May 10, 2019.

TECHNICAL FIELD

The invention relates to the field of antenna feed networks in a wireless communication system, in particular to a feed network for an antenna array with integrated filtering, power splitting and phase shifting.

TECHNICAL BACKGROUND

A feed network for an antenna is usually formed by passive devices such as power splitters, phase shifters, couplers etc., and is used in an antenna system with multiple radiating elements to meet the amplitude and phase distributions required for feeding each radiating element. In addition to the feed network, the antenna also needs to be cascaded with a filter to filter out other unwanted signals to avoid interference.

In conventional designs, power splitters, phase shifters, and filters are independently designed. Further, the power splitters, phase shifters, and other devices are cascaded to form a feed network, and then cascaded with the filters. This approach will bring unavoidable cascading mismatch problems, resulting in an increase in the overall circuit insertion loss, performance degradation, and a larger circuit volume. In addition, the antenna needs to take into account co-channel interference and optimal coverage. During beamforming, the amplitude distribution and phase distribution of each output of the feed network need to be adjusted through optimization. Among them, the adjustment of the phase distribution is more important. In order to better meet the phase distribution required by the antenna beamforming electrical downtilt, the feed network may flexibly adjust the phase difference of each output signal, and may have better applicability.

SUMMARY OF THE INVENTION

In order to overcome the shortcomings and deficiencies of the prior art, the present invention provides a feed network for an antenna array with integrated filtering, power splitting and phase shifting, to avoid cascading mismatch between circuits with different functions in conventional designs and to reduce insertion loss and circuit volume, and to improve overall performance. In addition, by moving the position of the phase-adjusting dielectric substrate, the phase difference between the output signals can be conveniently controlled to meet the phase distribution requirements for antenna radiation unit.

The object of the present invention may be achieved by the following technical solutions:

A feed network for an antenna array with integrated filtering, power splitting and phase shifting, comprising upper and lower metal floors, metal connecting posts, coaxial feed terminals, a suspended dielectric substrate, suspended strip lines and two phase-adjusting dielectric substrates;

The upper and lower metal floors share a common ground through the metal connecting posts, the suspended strip lines are provided on the suspended dielectric substrate, the suspended dielectric substrate is positioned horizontally between the two phase-adjusting dielectric substrates, the two phase-adjusting dielectric substrates are positioned horizontally between the upper and lower metal floors;

The suspended strip lines comprise a one-to-three filtering power splitting unit, two one-to-two unequal filtering power splitting units, two first phase-shifting lines and two second phase-shifting lines, the two phase-adjusting dielectric substrates cover the one-to-three filtering power splitting unit, part of the two first phase-shifting lines and the two second phase-shifting lines.

The two one-to-two unequal filtering power splitting units are arranged symmetrically on both sides of the one-to-three filtering power splitting unit, three output terminals of the one-to-three filtering power splitting unit output in-phase signals with equal amplitude, two of the output terminals are respectively connected to the first phase-shifting lines on both sides, and another output terminal is connected to a coaxial feed terminal;

Input terminals of the one-to-two filtering power splitting units are connected to the first phase-shifting lines, two output terminals output in-phase signals with unequal amplitude, which are respectively connected to the second phase-shifting lines and coaxial feed terminals.

A matching impedance of the three output terminals of the one-to-three filtering power splitting unit is 50 Ohm.

A matching impedance of the input terminals of the one-to-two filtering power splitting units is a corresponding characteristic impedance of the first phase-shifting lines without covering the phase-adjusting dielectric substrate, a matching impedance of the output terminals connected to coaxial feed terminals is 50 Ohm, a matching impedance of the other output terminals is a corresponding characteristic impedance of the second phase-shifting lines without covering the area of the phase-adjusting dielectric substrate.

The two phase-adjusting dielectric substrates are provided with two spaced apart rectangular grooves at both ends as matching units, by adjusting a width and a spacing of the rectangular grooves, a matching is achieved between two corresponding characteristic impedances when the first and second phase-shifting lines are uncovered or covered by the phase-adjusting dielectric substrate.

The line width of the first and second phase-shifting lines is set to a width with 50 Ohm characteristic impedance when covered by the phase-adjusting dielectric substrate.

The one-to-three filtering power splitting unit is formed by four open stub-loaded structures to provide a filtering function.

The one-to-two unequal filtering power splitting unit are formed by three open stub-loaded structures to provide a filtering function.

The output power ratio of the one-to-two unequal filtering power splitting unit is −1.6 dB:−5.1 dB.

There are six coaxial feed terminals and metal connecting posts, and the coaxial feed terminals comprise coaxial wires, inner conductors of the coaxial wires are soldered to a circuit of the suspended dielectric substrate through via holes of the metal connecting posts, and outer conductors of the coaxial wires are in contact with the metal connecting posts for grounding.

The feed network simultaneously provides three functions of filtering, power splitting and phase shifting.

The beneficial effects of the invention:

1. Compared with conventional designs by cascading multiple independently designed circuits with different functions, the integrated design of the three functional circuits with filtering, power splitting and phase shifting avoids cascading mismatch, reduces circuit insertion loss, and improves overall performance while reducing circuit volume.

2. By moving the position of the phase-adjusting dielectric substrates, the phase difference between the different output terminals of the feed network can be conveniently controlled to meet the phase distribution requirements for the antenna beamforming electrical downtilt.

DESCRIPTION

The present invention will be further described in detail below in conjunction with examples and figures, but the embodiments of the present invention are not limited thereto.

EXAMPLES

Figure 1:
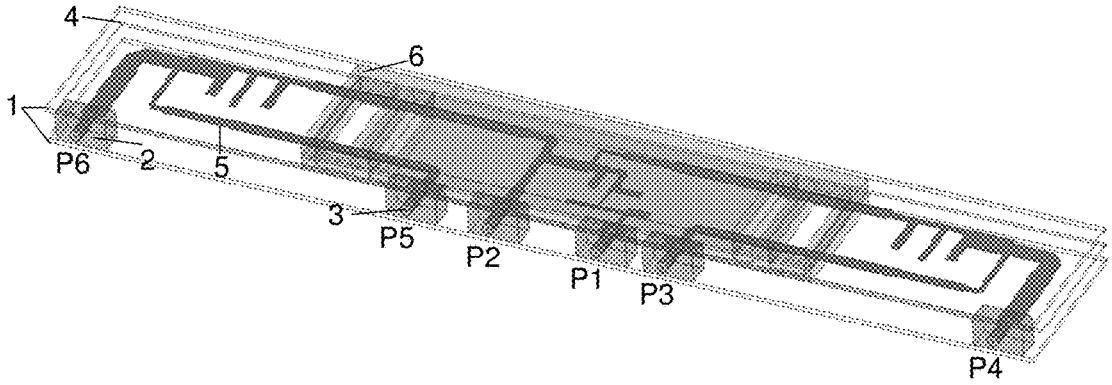
FIG. 1 is an illustrative view of a three-dimensional structure of the present invention.

As shown in FIG. 1, a feed network for an antenna array with integrated filtering, power splitting and phase shifting, comprises upper and lower metal floors 1, six metal connecting posts 2, coaxial feed terminals 3, and suspended dielectric substrate 4, suspended strip lines 5 and two phase-adjusting dielectric substrates 6. The structural dimensions of the two phase-adjusting dielectric substrates are the same. In this example, the center points of the upper and lower metal floors, the suspended dielectric substrate, and the two phase-adjusting dielectric substrates are all in a vertical straight line.

Figure 2:
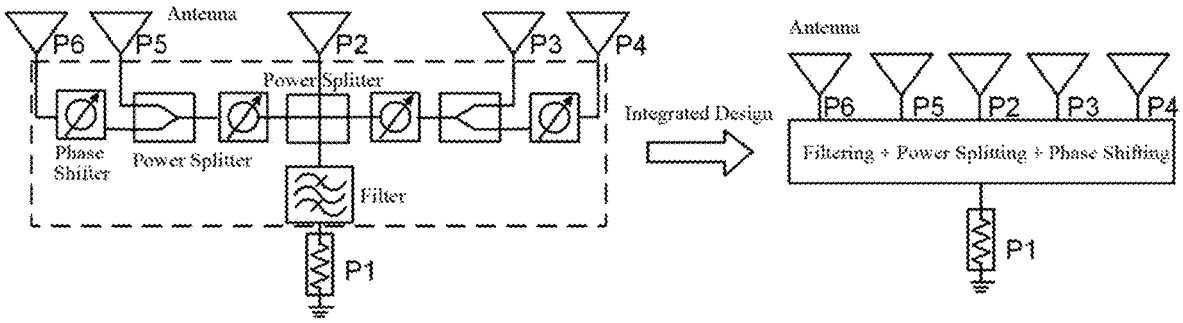
FIG. 2 is a functional block diagram of the present invention.

FIG. 2 shows the functional block diagram of the integrated design of the feed network of the present invention. The conventionally designed feed network is formed by a cascade of separately designed filters, power splitters and phase shifters. There are unavoidable cascade mismatch problem in the circuit. The present invention integrates multiple devices into a single integrated device to provide the original functions, improve the overall performance of the circuit, while reducing the circuit volume.

The upper and lower metal floors achieve common ground by six metal connecting posts arranged between the two layers of metal floors. The six metal connecting posts are arranged in a line. The upper and lower metal floors are placed horizontally.

The six coaxial feed terminals P1 to P6 are provided by soldering inner conductors of the coaxial wires to a circuit of the suspended dielectric substrate through through-holes of the metal connecting posts, and outer conductors of the coaxial wires are in contact with the metal connecting posts for grounding.

Figure 3:
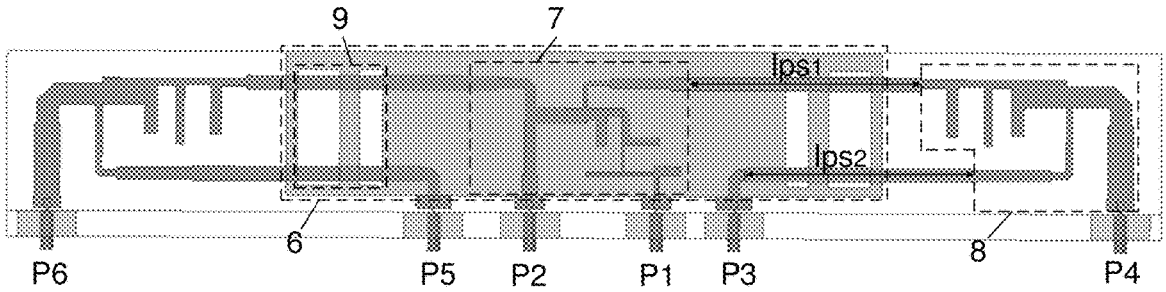
FIG. 3 is a top view of the present invention.
Figure 4A:
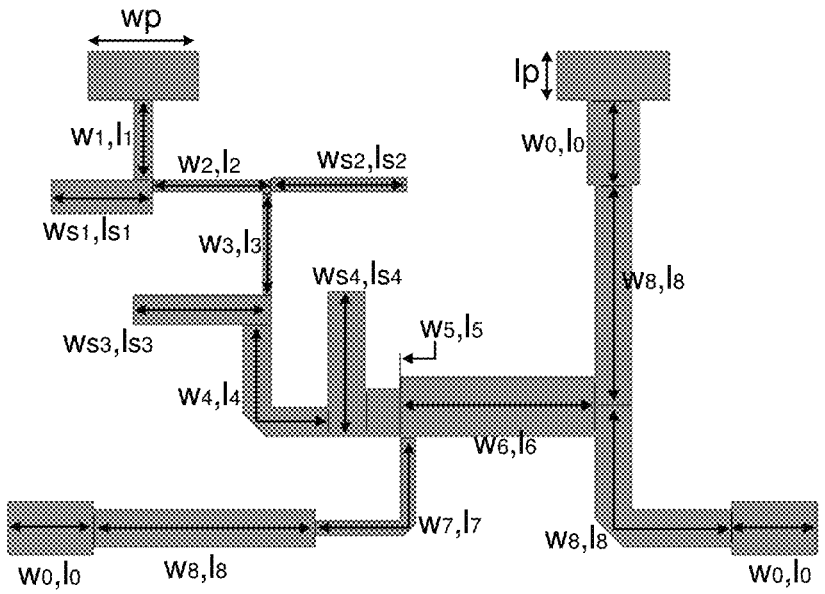
FIG. 4*a* is a dimension drawing of the one-to-three filtering power splitting unit of the feed network of the present invention.
Figure 4B:
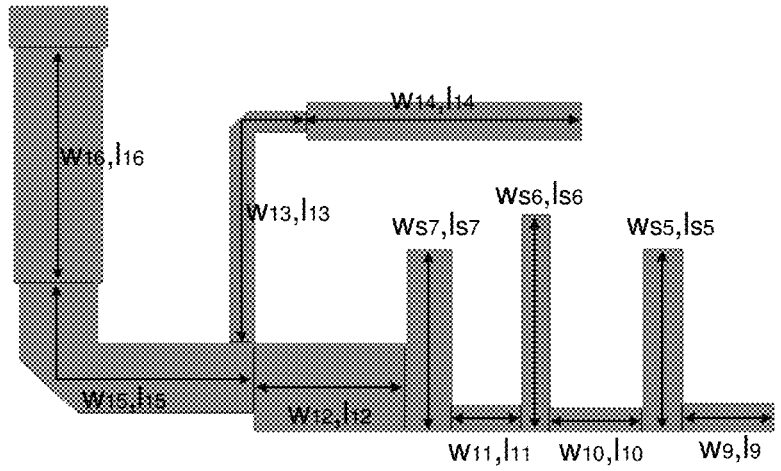
FIG. 4*b* is a dimension drawing of the one-to-two unequal filtering power splitting units of the feed network of the present invention.
Figure 4C:
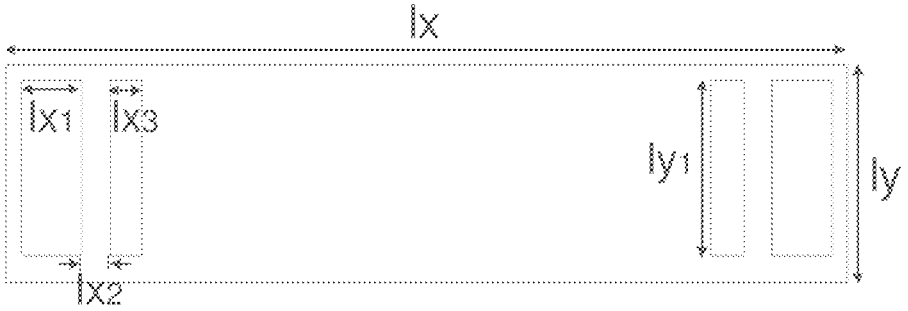
FIG. 4*c* is a dimension drawing of the phase-adjusting dielectric substrate of the feed network of the present invention.

As shown in FIG. 3, the two phase-adjusting dielectric substrates are placed horizontally between two layers of dielectric substrates. The suspended dielectric substrate is placed between the two phase-adjusting dielectric substrates. The suspended strip lines are printed on the suspended dielectric substrate. The suspended strip lines are printed on the suspended dielectric substrate and comprise a one-to-three filtering power splitting unit, two one-to-two unequal filtering power splitting units, two first phase-shifting lines, and two second phase-shifting lines. The one-to-three filtering power splitting unit is located in the middle position, the other circuits are arranged symmetrically on both sides of the one-to-three filtering power splitting unit, and the two phase-adjusting dielectric substrates cover the one-to-three filtering power splitting unit, part of the two first phase-shifting lines and the two second phase-shifting lines.

Two phase-adjusting dielectric substrates are provided with two spaced-apart rectangular grooves, which are used to change the characteristic impedance of suspended strip lines in the corresponding area. Among them, the strip lines corresponding to the rectangular grooves are high-impedance lines. The corresponding strip lines between the two grooves are low-impedance lines. The three partial strip lines form a stepped impedance structure, as the matching unit 9. By adjusting the width and spacing of the two rectangular grooves, the electrical length of each part of the stepped impedance structure is changed so that a matching is achieved between two corresponding characteristic impedances when the first and second phase-shifting lines are uncovered or covered by the phase-adjusting dielectric substrate. At the same time, by moving the phase-adjusting dielectric substrate, the areas of the first and second phase-shifting lines on the left and right sides covered by the dielectric substrate are changed, thereby changing the equivalent electrical length of the first and second phase-shifting lines on the left and right sides to provide different phase differences between the output terminals.

The one-to-three filtering power splitting unit 7 provides filtering functions through four open stub-loaded structures. The input terminal is connected to the coaxial feed terminal P1. The three outputs are in-phase with equal amplitude, and they are all matched to 50 Ohm. One of the outputs is connected to the coaxial feed terminal P2 and the other two outputs are connected to one end of the two first phase-shifting lines lps1.

As shown in FIG. 3, the filtering function of the one-to-two unequal filtering power splitting units 8 is provided through three open stub-loaded structures. The two outputs are in-phase with power ratio of −1.6 dB:−5.1 dB. The input is connected to the other end of the first phase-shifting line.

The matching impedance is a corresponding characteristic impedance of the first phase-shifting lines without covering the phase-adjusting dielectric substrate. One of its outputs is connected to the coaxial feed terminal P4 or P6.

The matching impedance is 50 Ohm. The other is connected to one end of the second phase-shifting lines lps2. The other end of the second phase-shifting lines lps2 is connected to the coaxial feed terminal P3 or P5. The matching impedance is a corresponding characteristic impedance of the second phase-shifting lines without covering the area of the phase-adjusting dielectric substrate. Among them, the line width of the first and second phase-shifting lines is set to a width with 50 Ohm characteristic impedance when covered by the phase-adjusting dielectric substrate.

In this example, the operating frequency of the feed network of the present invention is 1.4 to 2.7 GHz. The thickness of the board used for the processing of the suspended dielectric substrate is 0.2 mm. The relative dielectric constant is 3.38. The loss tangent is 0.0027. The thickness of the board used in the processing of the phase-adjusting dielectric substrate is 3.048 mm. The relative dielectric constant is 2.94. The loss tangent is 0.0012. The distance between the upper and lower metal floors is 6.4 mm. The corresponding size of the feed network marked in FIGS. 3 to 4*a*, 4*b*, 4*c* are as follows:

$w_0$=4.3 mm, $w_1$=1.4 mm, $w_2$=0.9 mm, $w_3$=0.7 mm, $w_4$=2.3 mm, $w_5$=3.8 mm, $w_6$=4.8 mm, $w_7$=1.2 mm, $w_8$=3.0 mm, $w_9$=2.6 mm, $w_{10}$=2.2 mm, $w_{11}$=2.5 mm, $w_{12}$=8.4 mm, $w_{13}$=2 mm, $w_{14}$=3.5 mm, $w_{15}$=6.6 mm, $w_{16}$=7.6 mm, $w_{s1}$=2.8 mm, $w_{s2}$=1.1 mm, $w_{s3}$=2.4 mm, $w_{s4}$=3 mm, $w_{s5}$=3.3 mm, $w_{s6}$=2.4 mm, $w_{s7}$=3.8 mm, $w_p$=9.2 mm, $I_0$=7 mm, $I_1$=6.6 mm, $I_2$=9.8 mm, $I_3$=8.6 mm, $I_4$=13.8 mm, $I_5$=2.9 mm, $I_6$=16 mm, $I_7$=15.2 mm, $I_8$=18.2 mm, $I_9$=7.8 mm, $I_{10}$=10.8 mm, $I_{11}$=6 mm, $I_{12}$=13.1 mm, $I_{13}$=26.6 mm, $I_{14}$=23.5 mm, $I_{15}$=30.2 mm, $I_{16}$=22.6 mm, $I_{s1}$=8.2 mm, $I_{s2}$=11.1 mm, $I_{s3}$=11.3 mm, $I_{s4}$=11.8 mm, $I_{s5}$=17.4 mm, $I_{s6}$=20.6 mm, $I_{s7}$=17.3 mm, $l_p$=4 mm, $l_{ps1}$=119 mm, $l_{ps2}$=105 mm, $l_x$=256.4 mm, $l_{x1}$=18 mm, $l_{x2}$=10.8 mm, $l_{x3}$=7.1 mm, $l_y$=51 mm, $l_{y1}$=36.1 mm.

Figure 5:
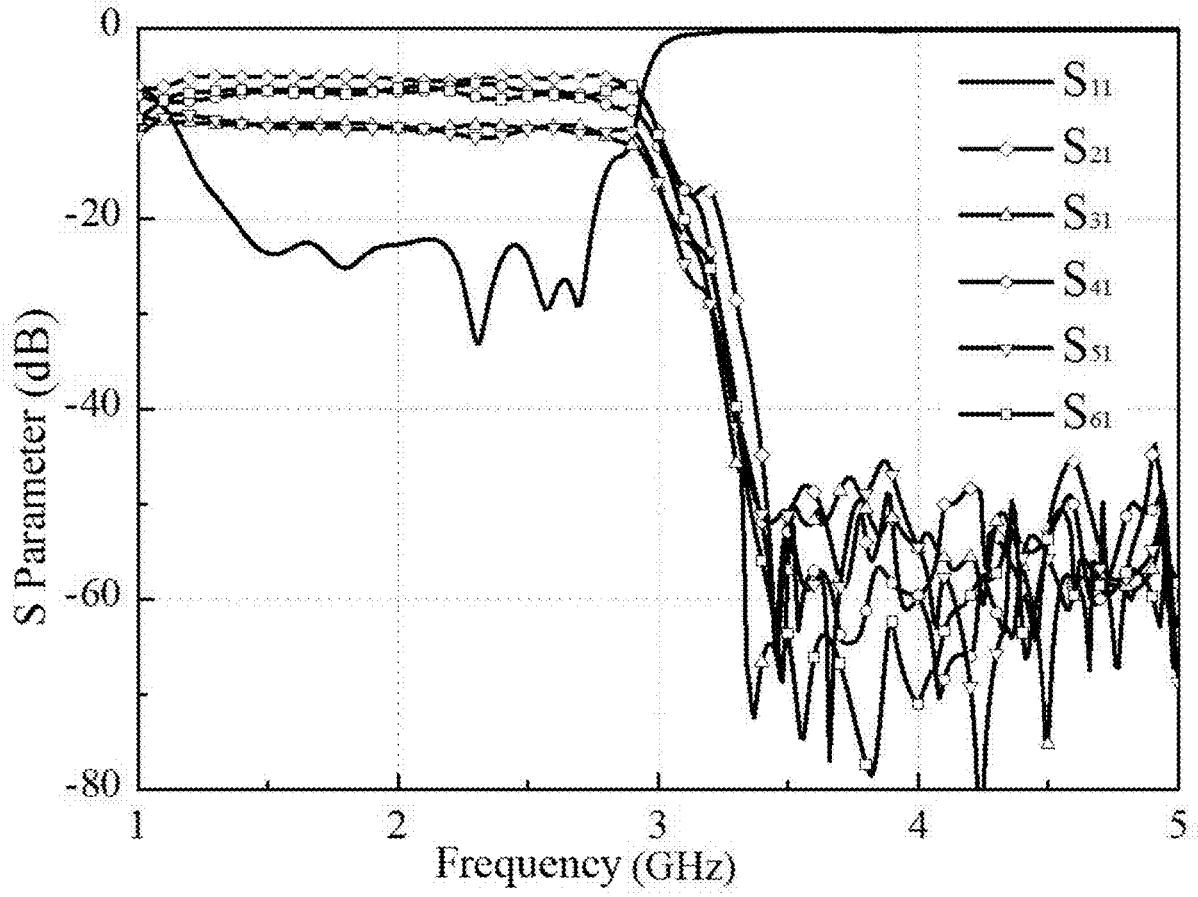
FIG. 5 is a graph of the frequency responses of the feed network of the present invention.

Shown in FIG. 5 is a graph of the frequency responses of the feed network of the present invention. In the passband range of 1.4 to 2.7 GHz, $S_{11}$ is less than −20 dB, indicating that the input terminal is well matched. Since the power ratio of one-to-two unequal filtering power splitting units in this example is −1.6 dB: −5.1 dB, ideally, the signal power ratio between each output terminal is $S_{21}$:$S_{31}$:$S_{41}$:$S_{51}$:$S_{61}$=−4.77 dB: −9.87 dB: −6.37 dB: −9.87 dB: −6.37 dB. It can be found from FIG. 5 that in the passband frequency range, the output signal amplitudes of terminal P3 and terminal P5 are substantially equal. The output signal amplitudes of terminal P4 and terminal P6 are substantially equal. The output signal amplitude imbalance is less than 1.5 dB. Excluding power distribution, the circuit insertion loss is not greater than 1.6 dB. In the out-of-band frequency range of 3.38 to 5 GHz, the suppression level is greater than 40 dB. The circuit has high sideband roll-off characteristics and out-of-band suppression capabilities, and good filtering performance.

Figure 6A:
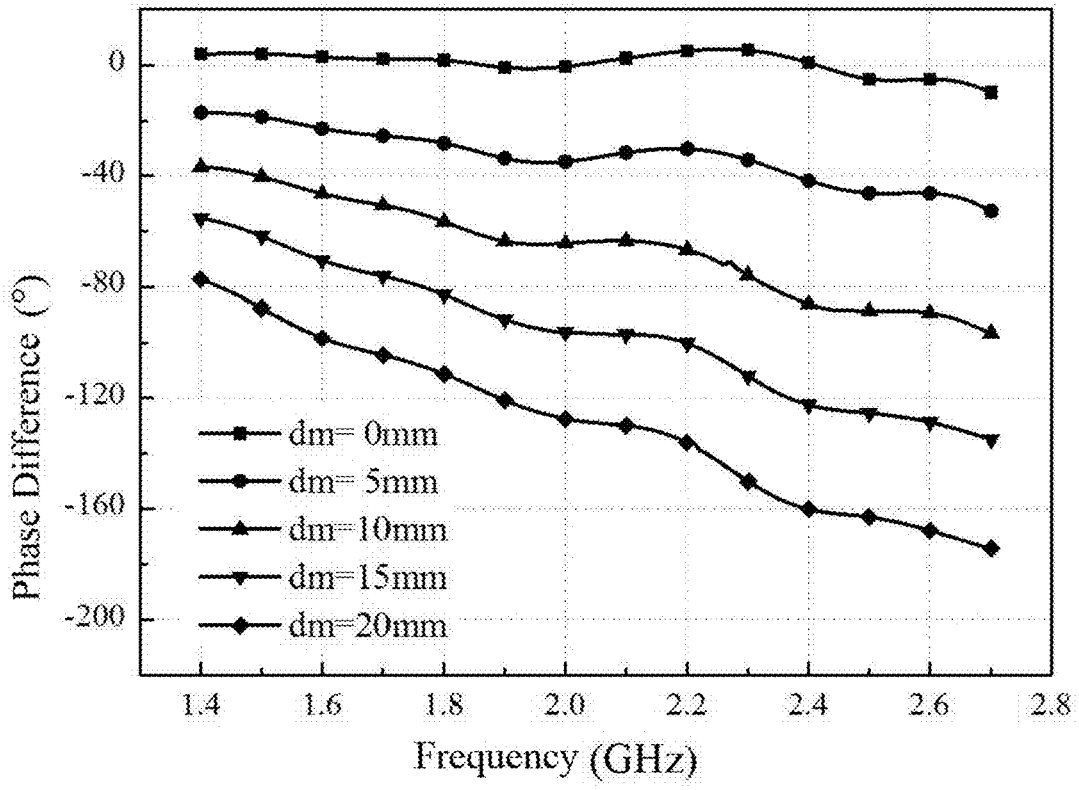
FIG. 6*a* shows the phase difference between the output signals of P3 and P5 when the phase-adjusting dielectric substrates of the feed network of the present invention move to the right.
Figure 6B:
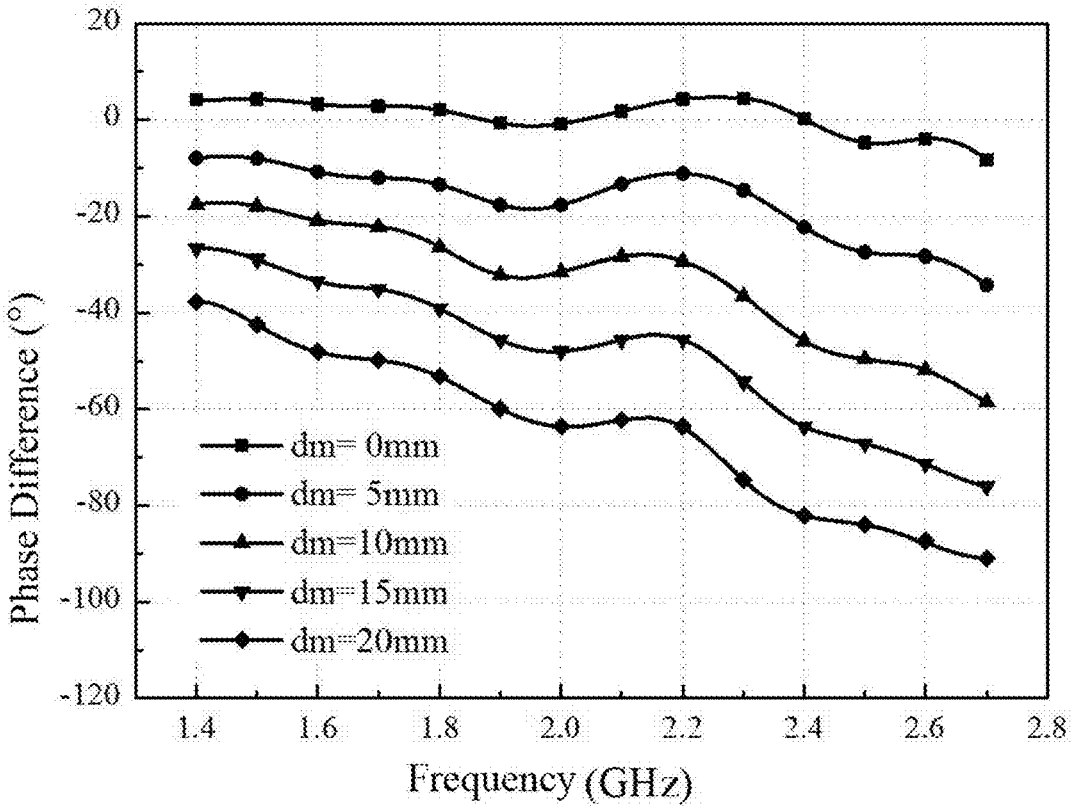
FIG. 6*b* shows the phase difference between the output signals of P4 and P6 when the phase-adjusting dielectric substrates of the feed network of the present invention move to the right.

Shown in FIG. 6*a* is the phase difference between the output signals of terminal P3 and terminal P5 when the phase-adjusting dielectric substrates of the feed network of the present invention move to the right (the moving distance is denoted by dm). FIG. 6*b* shows the phase difference between the output signals of terminal P4 and terminal P6. It can be seen that, when the phase-adjusting dielectric substrates are not moved (dm=0 mm), within the operating frequency range of 1.4 to 2.7 GHz, the output signals of terminal P3 and terminal P5 are basically in-phase. The output signals of terminal P4 and terminal P6 are basically in-phase. The greater the moving distance dm, the greater the phase difference between the output signals. When dm=20 mm, the phase difference of the output signals of terminal P3 and terminal P5 fluctuates between [−77.3°, −174.3° ] in the passband frequency range. The phase difference between the output signals of terminal P4 and terminal P6 fluctuates between [−37.7°, −90.9° ] in the passband frequency range. Since from terminal P1 to terminal P4 and terminal P6 the signals only go through first phase-shifting lines, and from terminal P1 to terminal P3 and terminal P5 the signals go through first and second phase-shifting lines, and due to symmetry, when the phase-adjusting dielectric substrate moves, the phase difference between the output signals of terminal P3 and terminal P5 is twice the phase difference between the output signals of terminal P4 and terminal P6, and the results basically conform to this rule.

In summary, the present invention provides a feed network for an antenna array with integrated filtering, power splitting and phase shifting, which integrates multiple functions of filtering, power splitting and phase shifting. Among them, by moving the positions of phase-adjusting dielectric substrates, the phase difference of the signals between the output terminals can be easily controlled. The circuit of the invention has various advantages such as low loss, high integration and small volume, and is suitable for many radio frequency systems.

The above examples are preferred embodiments of the present invention, but the embodiments of the present invention are not limited by the examples. Any other changes, modifications, substitutions, combinations, simplifications, made without departing from the spirit and principles of the present invention, should be equivalent replacement methods, are included in the scope of protection of the present invention.

The invention claimed is:

1. A feed network for an antenna array with integrated filtering, power splitting and phase shifting, characterized in that, comprising upper and lower metal floors, metal connecting posts, coaxial feed terminals, a suspended dielectric substrate, suspended strip lines and two phase-adjusting dielectric substrates;

the upper and lower metal floors share a common ground through the metal connecting posts, the suspended strip lines are provided on the suspended dielectric substrate, the suspended dielectric substrate is positioned horizontally between the two phase-adjusting dielectric substrates, the two phase-adjusting dielectric substrates are positioned horizontally between the upper and lower metal floors;

the suspended strip lines comprise a one-to-three filtering power splitting unit, two one-to-two unequal filtering power splitting units, two first phase-shifting lines and two second phase-shifting lines, the two phase-adjusting dielectric substrates cover the one-to-three filtering power splitting unit, part of the two first phase-shifting lines and the two second phase-shifting lines.

2. The feed network for an antenna array according to claim 1, characterised in that, the two one-to-two unequal filtering power splitting units are arranged symmetrically on both sides of the one-to-three filtering power splitting unit, three output terminals of the one-to-three filtering power splitting unit output in-phase signals with equal amplitude, two of the output terminals are respectively connected to the first phase-shifting lines on both sides, and another output terminal is connected to a coaxial feed terminal;

input terminals of the one-to-two filtering power splitting units are connected to the first phase-shifting lines, two output terminals output in-phase signals with unequal amplitude, which are respectively connected to the second phase-shifting lines and coaxial feed terminals.

3. The feed network for an antenna array according to claim 2, characterised in that, a matching impedance of the three output terminals of the one-to-three filtering power splitting unit is 50 Ohm.

4. The feed network for an antenna array according to claim 2, characterised in that, a matching impedance of the input terminals of the one-to-two filter power splitting units is a corresponding characteristic impedance of the first phase-shifting lines without covering the phase-adjusting dielectric substrate, a matching impedance of the output terminals connected to coaxial feed terminals is 50 Ohm, a matching impedance of the other output terminals is a corresponding characteristic impedance of the second phase-shifting lines without covering the area of the phase-adjusting dielectric substrate.

5. The feed network for an antenna array according to claim 1, characterized in that, the two phase-adjusting dielectric substrates are provided with two spaced-apart rectangular grooves at both ends as matching units, by adjusting a width and a spacing of the rectangular grooves, a matching is achieved between two corresponding characteristic impedances when the first and second phase-shifting lines are uncovered or covered by the phase-adjusting dielectric substrate.

6. The feed network for an antenna array according to claim 1, characterised in that, the line width of the first and second phase-shifting lines is set to a width with 50 Ohm characteristic impedance when covered by the phase-adjusting dielectric substrate.

7. The feed network for an antenna array according to claim 1, characterised in that, the one-to-three filtering power splitting unit is formed by four open stub-loaded structures to provide a filtering function;

the one-to-two unequal filtering power splitting unit are formed by three open stub-loaded structures to provide a filtering function.

8. The feed network for an antenna array according to claim 1, characterised in that, the output power ratio of the one-to-two unequal filtering power splitting unit is −1.6 dB:−5.1 dB.

9. The feed network for an antenna array according to claim 1, characterised in that, there are six coaxial feed terminals and metal connecting posts, and the coaxial feed terminals comprise coaxial wires, inner conductors of the coaxial wires are soldered to a circuit of the suspended dielectric substrate through via holes of the metal connecting posts, and outer conductors of the coaxial wires are in contact with the metal connecting posts for grounding.

10. The feed network for an antenna array according to claim 1, characterised in that, the feed network simultaneously provides three functions of filtering, power splitting and phase shifting.

* * * * *